United States Patent [19]

Otenbaker

[11] 4,134,394

[45] Jan. 16, 1979

[54] AIR VENTILATION SYSTEM

[76] Inventor: James T. Otenbaker, 53415 Starlite, Utica, Mich. 48087

[21] Appl. No.: 771,640

[22] Filed: Feb. 24, 1977

[51] Int. Cl.[2] ..... F24C 15/08; F23J 11/00

[52] U.S. Cl. ..... 126/299 D; 55/DIG. 36; 98/36

[58] Field of Search ..... 98/36; 126/299 D; 55/DIG. 36

[56] References Cited

U.S. PATENT DOCUMENTS

| | | | |
|---|---|---|---|
| 3,457,850 | 7/1969 | Sweet et al. | 126/299 D |
| 3,978,777 | 9/1976 | Nett | 55/DIG. 36 |

*Primary Examiner*—Ronald C. Capossela
*Attorney, Agent, or Firm*—Basile and Weintraub

[57] ABSTRACT

An air ventilation system for use in conjunction with a cooking exhaust hood for exhausting cooking vapors, odors and the like from the air space above a commercial kitchen stove. The exhaust hood defines an air space above the stove and includes an exhaust fan which draws a predetermined amount of air from the air space between the hood and the stove. The hood includes a primary air passage along the internal front perimeter of the hood canopy for inducing air into the air space to replenish a substantial portion of the air exhausted through the hood. Air is supplied to the primary air passage by means of a motorized fan drawing outside air into the passage. A secondary air passage is also provided on the outer face of the hood canopy for directing conditioned air in front of the hood and stove to provide a curtain of air for preventing odors and cooking vapors from escaping from the stove while a portion of the secondary air supply is directed into the air space above the stove cooking surface and exhausted through the exhaust hood. In the preferred embodiment the conditioned air is obtained from a heat return duct such that in winter months warm air is directed through the secondary air passage providing warm air to the personnel within the kitchen, while in the summer months cool air is directed through the secondary air passage to again provide a comforting condition for the kitchen personnel.

5 Claims, 1 Drawing Figure

AIR VENTILATION SYSTEM

BACKGROUND OF THE INVENTION

I. Field of the Invention

The present invention relates to ventilation systems cooking in particular, to an air ventilation system for a cooling exhaust hood.

II. Description of the Prior Art

Heretofore, numerous exhaust hoods have been constructed for the purpose of providing an exhaust system for ridding a kitchen of cooking vapors and odors. In conventional units the kitchen air, which has been heated or cooled, is totally exhausted through the hood and, thus, wastes substantial amounts of energy. In order to overcome the problem of wasting energy through exhausting all the air in the kitchen, it has been suggested that make-up units be provided wherein a substantial portion of the air which is exhausted is supplied in the form of outside, untempered air. This may be accomplished by directing air from a forward passage located on the periphery of the hood canopy downwardly toward the stove. In such systems the air, which is usually cooled, is directed right onto the kitchen personnel and may prove to be very uncomfortable. It has also been suggested that the air be emitted through vents disposed in the rear of the cooking surface which function to create a vertical venturi acting upward to draw fumes and heat from the cooling surface for delivery to the exhaust system. These systems have the disadvantage in that they are not completely effective from preventing kitchen odors, grease and smoke from entering into the kitchen area.

SUMMARY OF THE INVENTION

The present invention, which will be described subsequently in greater detail, comprises an air ventilation system for a cooking exhaust hood wherein a primary source of untempered air is supplied to the exhaust hood and emitted through a primary passage in the forward portion of the hood to provide for substantial make-up of the air exhausted through the hood. A secondary supply passage carried at the forward end of the hood communicates treated air from the building interior to create an air curtain in front of the cooking area to prevent fumes, smoke and grease from being exhausted into the kitchen area while creating an upward venturi action drawing the fumes and heat from the cooking surface for delivery into the exhaust hood.

It is therefore a primary object of the present invention to provide an air ventilation system for use in conjunction with commercial stoves which will exhaust fumes, smoke, grease and the like from over the cooking equipment without exhausting the heated or air-conditioned air from within the kitchen.

It is a further object of the present invention to provide an air ventilation system of the type described which will exhaust fumes, smoke, grease and the like from over the cooking equipment without permitting said fumes, smoke and grease from being drawn into the main kitchen.

It is still a further object of the present invention to provide an air ventilation system of the type described which will accomplish the aforementioned objectives without inconvenience or discomfort to the kitchen personnel.

Other objects, advantages and applications of the present invention will become apparent to those skilled in the air of air ventilation systems when the accompanying description of one example of the best mode contemplated for practicing the invention is read in conjunction with the accompanying drawing.

BRIEF DESCRIPTION OF THE DRAWING

The description herein makes reference to the accompanying drawing wherein the sole FIGURE is a schematic representation of a building having kitchen and dining areas which employ an air ventilation system constructed in accordance with the principles of the present invention.

DESCRIPTION OF THE PREFERRED EMBODIMENT

Figure 1:
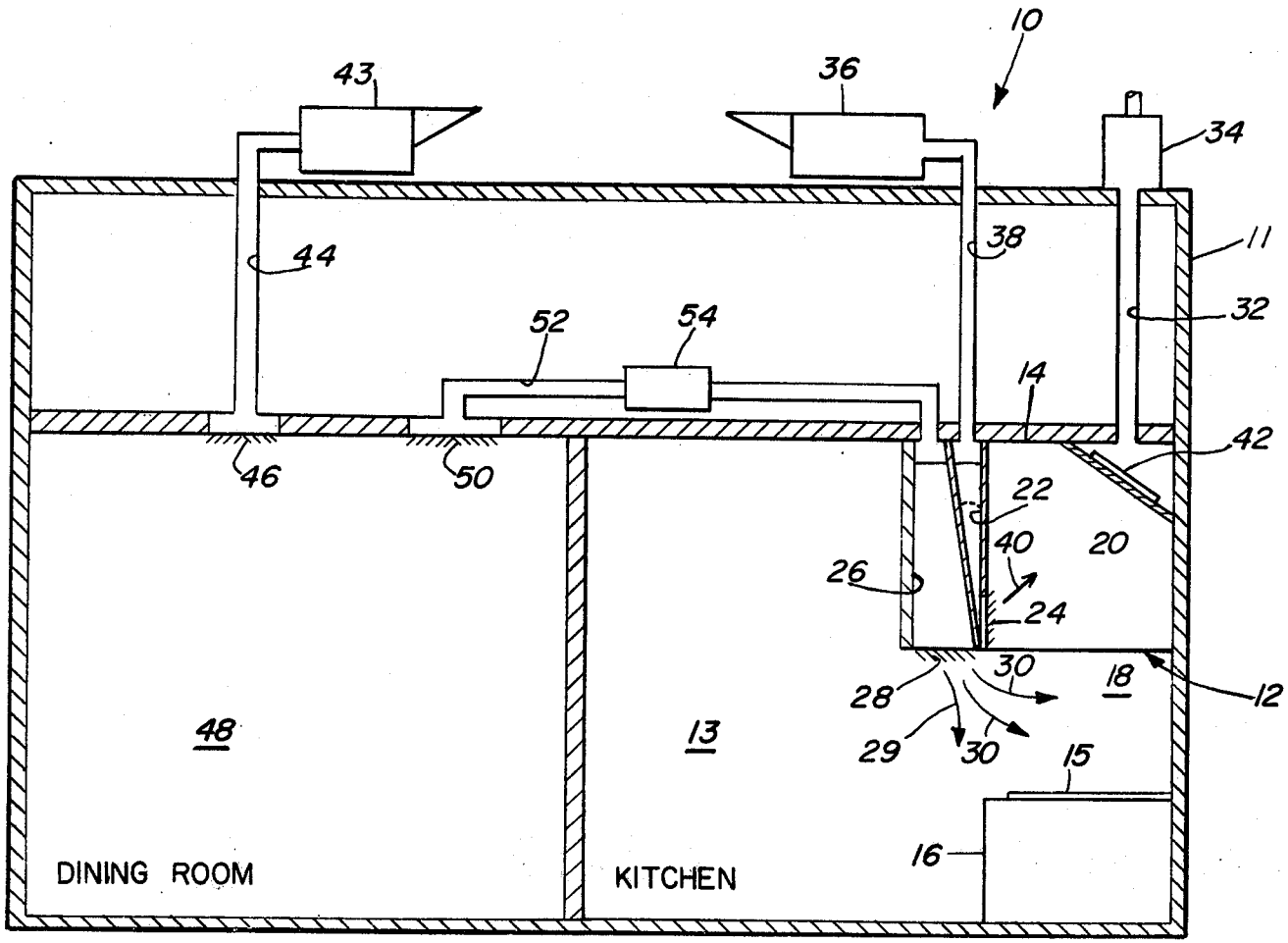

Referring now to the drawing wherein there is illustrated one example of the present invention in the form of an air ventilation system 10. The system 10, which is disposed in a building 11, comprises an exhaust hood 12 that has a canopy 14 that is mounted in a kitchen 13 above the cooking surface 15 of a stove 16 to define thereinbetween a working air space 18. Within the interior of the hood 12 there is defined a second air space 20. On the forward portion of the hood 12, the canopy 14 is provided with a primary air passage 22 which extends across the front of the hood for directing a stream of untempered air through louvers 24 into air space 20. The louvers 24 are disposed at approximately a 15° angle with respect to the vertical wall of the passage 22 so that the air passing through the primary passage 22 is exhausted upwardly towards the upper portion of the hood air space 20. the primary passage 22 and the source of air therefor will be described hereinafter.

Forward of the primary air passage 22, the canopy 14 has a secondary air passage 26 which is adapted to direct a stream of air through louvers 28 in front of the working air space 18 to define an air curtain 29, which will be described in greater detail hereinafter. A portion of the air emitted through the secondary passage 26 is communicated to the working air space 18, as indicated by the arrows 30. This air rises upwardly and is exhausted by the hood 12 in the manner which will be described hereinafter.

The building 11 within which the inventive air ventilation system 10 is mounted includes an exhaust duct 32 which communicates the air space 20 of the exhaust hood 12 to an exhaust ventilator fan 34. The fan 34 is adapted to function in such a manner as to draw a predetermined amount of air from within the air space 20 of the hood 12. The amount of air drawn will depend upon the size of the cooking equipment and the amount of air which is necessary to be drawn from the hood 12 in order to insure that the fumes, smoke, grease and the like are removed in a satisfactory manner. In order to minimize the amount of treated air that is removed from the kitchen 13, the primary air supply passage 22 is communicated to a fresh-air make-up unit 36 by means of air duct 38. The make-up unit 36 may be a motorized fan and filter arrangement which draws fresh air from outside the building 11 and directs the same down to the primary air passage 22 and through the louvers 24 into the air space 20 of the hood 12. It can be seen from the arrow 40 that the direction of the air from the primary passage 22 is up toward the exhaust duct 32. In the preferred design, up to 80% of the air exhausted by the fan 34 is replenished from outside untempered air supplied from the primary air passage 22 through the louvers 24 at the forward portion of the hood 12. This volume of air causes a vertical venturi action drawing the fumes, smoke, odors and grease from the cooking surface 15 of the cooking equipment 16 for delivery to the hood 12 and then is exhausted through the duct 32 and ventilator fan 34.

The hood 12 further comprises a conventional grease filter 42 which is positioned in the air space 20 of the hood 12 so that all of the air exhausted through the exhaust duct 32 must first pass through the grease filter 42 so as to remove hot grease and the like from the air.

As can be seen in the schematic figure, the building 11 includes a conventional furnace 43 adapted to draw a predetermined percentage of the outside air into the building heating system, which air is heated and communicated via hot-air duct 44 to the hot-air inlet 46 to provide heating of a dining room 48 in the conventional manner. In addition to the cold-air returns of the conventional forced-air system, the dining room 48 includes a return vent 50 which is communicated via an air duct 52 and a motorized fan 54 to the secondary passage 26. It can thus be seen that the air, which is directed through the louvers 28 of the secondary air passage 26, is treated air in that in the winter time, when the furnace 43 is in operation, the air is heated. This heated air is directed downwardly and provides the curtain of air, as signified by the arrow 29, to prevent the kitchen air from being exhausted through the hood 12. At the same time a substantial portion of the secondary air supply is directed in close proximity to the cooking surface 15 of the cooking equipment 16 causing a vertical venturi action drawing the fumes, heat, grease and the like from the cooking surface 15 upwardly toward the exhaust hood 12 which, in conjunction with the primary supply of air 40, insures that all of the cooking grease, smoke, fumes, odors and the like are withdrawn through the exhaust ventilator 34. The secondary air supply provides the primary function of preventing the odors, smoke, grease, fumes and the like from passing through the air curtain 29, as the entire flow of air is such as to be directed inwardly and up towards the exhaust hood 12. Since the total amount of air from the make-up air unit 36 (80%) and the fan 54 (20%) is equal to the amount of air displaced by the exhaust ventilator 34, none of the air within the kitchen 13 will be drawn through the ventilator hood 12. It can thus be seen that a substantial portion of the treated air within the kitchen 13, that is, air which is heated in the winter and cooled in the summer, will remain in its heated stage within the kitchen and will not be needlessly exhausted through the exhaust fan; and, thus, the aforementioned problem of exhausting treated air is virtually eliminated.

It can also be seen that the warm air being exhausted through the louvers 28 from the secondary air passage 26 will also be directed on the kitchen personnel working near the cooking equipment; however, since the air is warm, it will not result in any unpleasant or uncomfortable effects on such kitchen personnel.

Likewise, when the dining room 48 is cooled, as during the summer months, and cool air is drawn from the dining room through the duct 52 and the fan 54 to the secondary air supply passage 26, cool air will be directed upon the kitchen personnel; however, the same will function to provide additional comfort to the kitchen personnel during the hot summer months.

It can thus be seen that the present invention provides a new and improved air ventilation system for a cooking exhaust hood which is effective to remove fumes, smoke, grease, odors and the like from over cooking equipment without the needless exhausting of the treated air in the kitchen.

It should be understood by those skilled in the art of air ventilation systems that other forms of applicant's invention may be had, all coming within the spirit of the invention and scope of the appended claims.

What is claimed is as follows:

1. An air ventilation system for a cooking exhaust hood adapted to be disposed in a building having an air treating means, said system comprising:

an exhaust hood defining a first air space within the interior of said hood, said hood being adapted to be positioned above cooking equipment such that the space above the cooking equipment defines a second air space between said hood and said cooking equipment;

said hood having a first opening registering with said second air space and communicating said first air space with said second air space, said first opening being disposed in a level plane;

means associated with said hood for exhausting a predetermined amount of air from said first and second air spaces to exhaust cooking vapors, odors, fumes, smoke and the like from said spaces, said hood having a second opening communicating with said first air space, said second opening being in an upright plane;

passage means integral with said hood for communicating air to said second opening;

a source of fresh air;

duct means connecting said source of fresh air to said passage means and thus to said first air space via said second opening to replenish a substantial portion of the air exhausted from said first air space;

a distribution manifold integral with said hood;

a source of treated air which bypasses said air treating means;

duct means communicating said treated air to said distribution manifold; said distribution manifold extending longitudinally throughout substantially the entire longitudinal dimension of said exhaust hood, said manifold having an air curtain register disposed in a substantially horizontal plane which is adjacent to said first hood opening; and said air curtain register having means for directing said treated air downwardly with a sufficient velocity to create an air curtain in front of said cooking equipment, a portion of said treated air being communicated to said air space above said cooking equipment for replenishing the air exhausted from said second air space.

2. The air ventilation system defined in claim 1 wherein said ventilation system is disposed within a building, said hood being disposed in a kitchen in close proximity to said cooking equipment; said building having a second, separate room and means for conditioning the air in said second room;

said duct means communicating the conditioned air in said second room to said distribution manifold and bypassing said means for conditioning said air; and fan means for communicating said conditioned air to said exhaust hood distribution manifold.

3. The air ventilation system defined in claim 2 wherein the air-conditioned room is heated.

4. The air ventilation system defined in claim 2 wherein said air-conditioned room is cooled.

5. The air ventilation system defined in claim 1 wherein said first duct means comprises a passageway disposed at the forward portion of said hood;

louver means directing said fresh air through said passage means directly into the interior of said hood toward said exhaust portion of said hood; and said second duct means comprising a second passage means mounted forwardly of said first passage means and having louver means directing said treated air downwardly in front of said cooking equipment.

* * * * *

UNITED STATES PATENT AND TRADEMARK OFFICE

CERTIFICATE OF CORRECTION

PATENT NO. : 4,134,394

DATED : January 16, 1979

INVENTOR(S) : James T. Otenbaker

It is certified that error appears in the above-identified patent and that said Letters Patent are hereby corrected as shown below:

Column 1, line 5, delete "cooking" and add --and--;

Column 1, line 27, delete "cooling" and add --cooking--;

Column 2, line 1, delete "air" and add --art--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*